US006106342A

United States Patent [19]

Kameoka

[11] Patent Number: 6,106,342

[45] Date of Patent: Aug. 22, 2000

[54] OUTBOARD MOTOR

[75] Inventor: Kentaro Kameoka, Hamamatsu, Japan

[73] Assignee: Sanshin Kogyo Kabushiki Kasiha, Japan

[21] Appl. No.: 09/096,704

[22] Filed: Jun. 12, 1998

[30] Foreign Application Priority Data

Jun. 12, 1997 [JP] Japan ..... 9-155310

[51] Int. Cl.[7] ..... B63H 5/125

[52] U.S. Cl. ..... 440/53; 77/84; 77/900

[58] Field of Search ..... 440/49, 53, 77, 440/86, 900, 113, 85, 84; 114/153

[56] References Cited

U.S. PATENT DOCUMENTS

| | | | |
|---|---|---|---|
| 2,549,485 | 4/1951 | Kiekhaefer | 440/900 |
| 3,121,415 | 2/1964 | Anderson . | |
| 4,151,807 | 5/1979 | Black, Jr. | 114/153 |
| 4,412,826 | 11/1983 | Jones et al. | 440/86 |
| 5,137,481 | 8/1992 | Wengler | 440/77 |
| 5,582,527 | 12/1996 | Nakamura . | |

OTHER PUBLICATIONS

1. European Search Report dated Apr. 23, 1999.

2. Patent Abstracts of Japan, vol. 004, No. 009 (M–089), Jan. 23, 1980 & JP 54 146395 A (Yamaha Motor Co., Ltd.:Others: 01), Nov. 15, 1979.

3. Patent Abstracts of Japan, vol. 013, No. 223 (M–829), May 24, 1989 & JP 01 036600 A (Sanshin Ind Co., Ltd), Feb. 7, 1989.

*Primary Examiner*—Stephen Avila

*Attorney, Agent, or Firm*—Knobb, Martens, Olson, Bear, LLP

[57] ABSTRACT

An outboard motor comprising a water propulsion device and a cowling housing an internal combustion engine is disclosed. The engine has a body defining at least one combustion chamber and an output shaft arranged to drive the water propulsion device. The cowling has a front end and a rear end. The motor includes a handle which generally encircles at least a portion of the cowling, the handle having at least one gripping portion at the front or rear end of the cowling.

23 Claims, 10 Drawing Sheets

OUTBOARD MOTOR

FIELD OF THE INVENTION

The present invention relates to an outboard motor. More particularly, the invention is such a motor having a cowling which includes a protective carrying handle.

BACKGROUND OF THE INVENTION

In the past, outboard motors for use in powering watercraft were generally very large and heavy. With advances in engine technology, it has been possible to design a variety of very small outboard motors which are both efficient and powerful.

These small outboard motors are very desirable for a number of reasons. First, these motors are lightweight and can be attached to small watercraft which would not support the traditional larger motors. These motors can also be quickly attached to and removed from the watercraft by a single person. When the outboard motor can be disconnected from the watercraft, the watercraft can more easily be stored or transported, such as on the roof of a vehicle. The outboard motor may be placed in the bed of a pickup or the like.

There are several problems with these smaller motor which result primarily from the ability of a user to carry or move the motor. While relatively small and lightweight, the shape of the motor makes the motor difficult to pick up and carry. As a result, the motor may be dropped and damaged. This problem is exacerbated by the fact that to keep the weight of the motor to a minimum, less structural support may be provided for protecting the engine in the cowling.

An improved outboard motor which overcomes the above-stated problems is desired.

SUMMARY OF THE INVENTION

In accordance with the present invention, there is provided an improved outboard motor. The outboard motor comprises a water propulsion device and a cowling housing an internal combustion engine.

The engine has a body defining at least one combustion chamber and an output shaft arranged to drive the water propulsion device.

The cowling has a front end and a rear end. The motor includes a handle which generally encircles at least a portion of the cowling, the handle having at least one gripping portion at the front or rear end of the cowling.

In a preferred arrangement, the handle comprises a front handle and a rear handle, each of which has a grip. The grip of the front handle is generally vertically aligned with a center of gravity of the outboard motor when the motor is being carried.

Further objects, features, and advantages of the present invention over the prior art will become apparent from the detailed description of the drawings which follows, when considered with the attached figures.

BRIEF DESCRIPTION OF THE DRAWINGS

FIG. 8(*b*) is a top view of the carrying handle illustrated in FIG. 8(*a*);

FIG. 8(*c*) is a first side view of the carrying handle illustrated in FIG. 8(*a*);

FIG. 8(*d*) is a second side view of the carrying handle illustrated in FIG. 8(*a*) opposite to that illustrated in FIG. 8(*c*);

FIG. 9(*b*) is a top view of the handle illustrated in FIG. 9(*a*);

FIG. 9(*c*) is a first side view of the handle illustrated in FIG. 9(*a*);

FIG. 9(*d*) is a second side view of the handle illustrated in FIG. 9(*a*) opposite to that illustrated in FIG. 9(*c*);

FIG. 10(*b*) is a side view of the mounting member illustrated in FIG. 10(*a*);

FIG. 10(*c*) is a cross-sectional view of the mounting member illustrated in FIG. 10(*a*);

FIG. 10(*d*) is an end view of the mounting member illustrated in FIG. 10(*a*); and FIG. 10(*e*) is a bottom view of the mounting member illustrated in FIG. 10(*a*).

DETAILED DESCRIPTION OF THE PREFERRED EMBODIMENTS OF THE INVENTION

Figure 1:
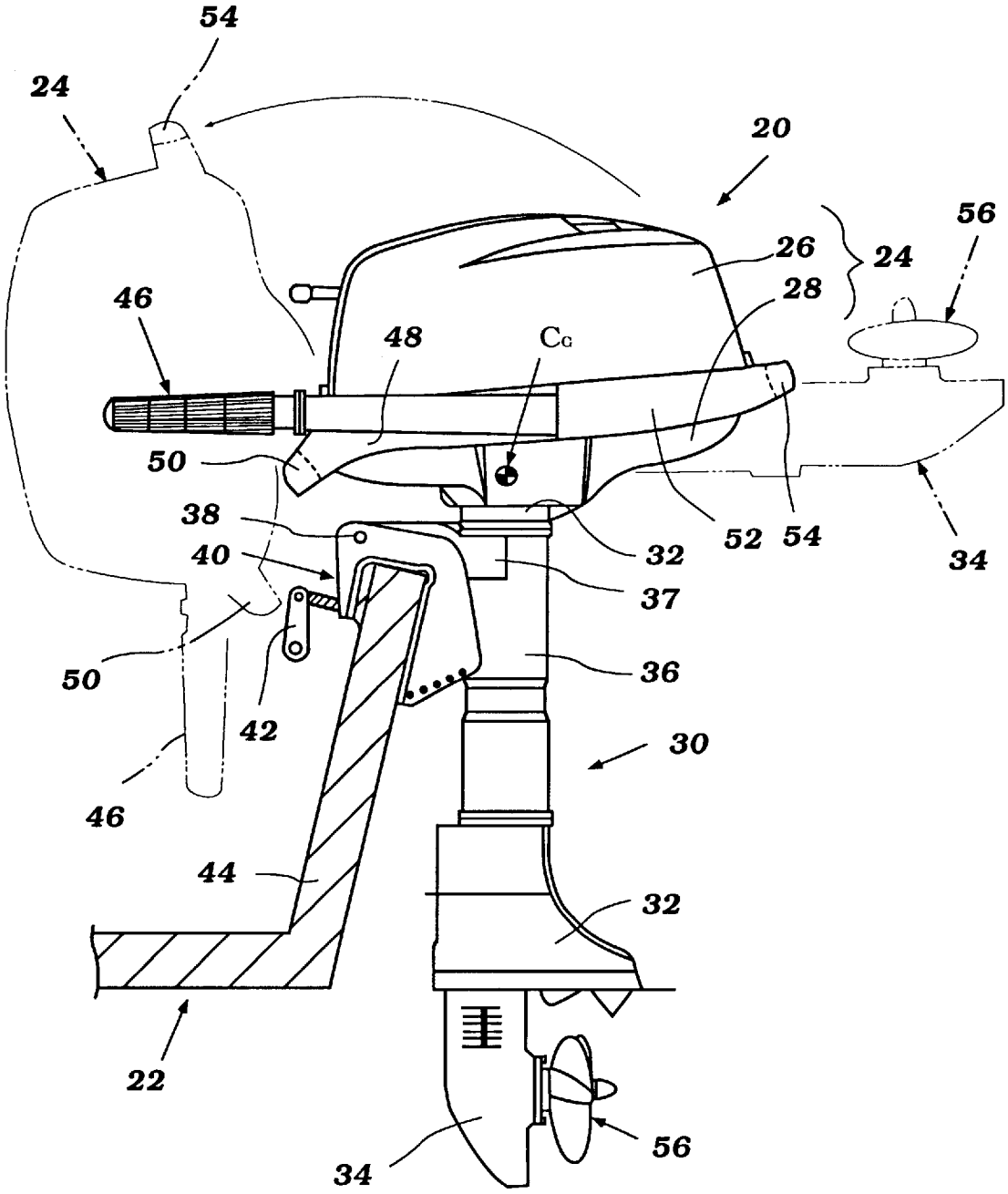
FIG. 1 is a side view of an outboard motor arranged in accordance with the present invention coupled to a hull of a watercraft, the motor illustrated in solid lines in a drive position and in phantom lines in a tilted-up position.
Figure 2:
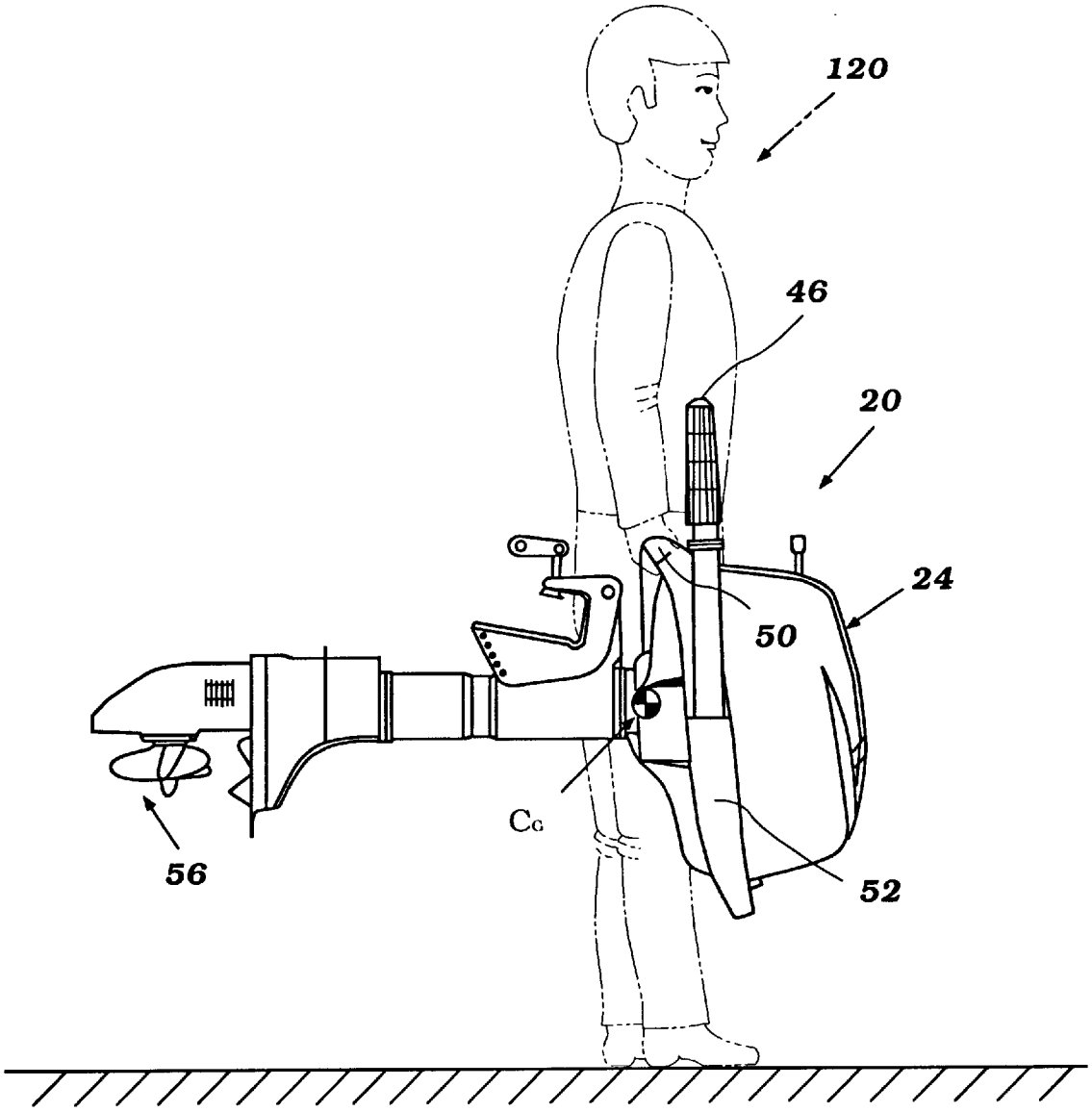
FIG. 2 illustrates the outboard motor illustrated in FIG. 1 uncoupled from the watercraft and being carried by a person.

The present invention is an outboard motor. The outboard motor includes a powered water propulsion device, making it useful for powering a watercraft through water, as illustrated in FIG. 1. In accordance with the present invention, the outboard motor is portable and includes a handle for use by a user in carrying the motor, as illustrated in FIG. 2.

Referring to FIG. 1, an outboard motor 20 in accordance with the present invention is illustrated connected to a watercraft 22 for use in powering the watercraft through a body of water. The outboard motor 20 includes a main cowling 24 comprised of an upper cowling 26 removably connected to a lower cowling 28. The main cowling 24 is positioned above a lower unit 30 comprising an upper case 32 and a lower case 34.

The outboard motor 20 is preferably arranged to be movably mounted with respect to the watercraft 22. The lower unit 30 is movably mounted about a vertical axis with respect to a swivel bracket 36. The swivel bracket 36 is, in turn, mounted for rotation about a horizontal axis by a bracket 37 which is mounted to a pin 38 which is connected to a clamping bracket 40.

The clamping bracket 40 includes a clamping handle 42 for tightening against a hull 44 of the watercraft 22. The clamping handle 42 comprises a threaded rod which engages the clamping bracket 40 and includes a foot for pressing against the hull 44 of the watercraft 22. The user may easily connect or disconnect the motor 20 from the watercraft 22 with the clamping bracket 40.

A steering handle 46 is connected to the main cowling 24 of the outboard motor 20. By moving the steering handle 46 to the left and right, the operator of the motor 20 rotates the motor 20 about the vertical axis, steering the motor 20 and thus the watercraft 22. By pressing down on the steering handle 46, the user may raise or trim the motor 20 out of the water into the position illustrated in phantom lines in FIG. 1.

As described in greater detail below, the motor 20 includes a handle which both protects the main cowling 24 and is useful in carrying the motor 20. This handle preferably comprises a front carrying handle 48 including a grip 50, and a rear handle 52 having a grip 54.

The motor 20 also includes a water propulsion device. As illustrated in FIGS. 1 and 2, this device comprises a propeller 56.

Figure 3:
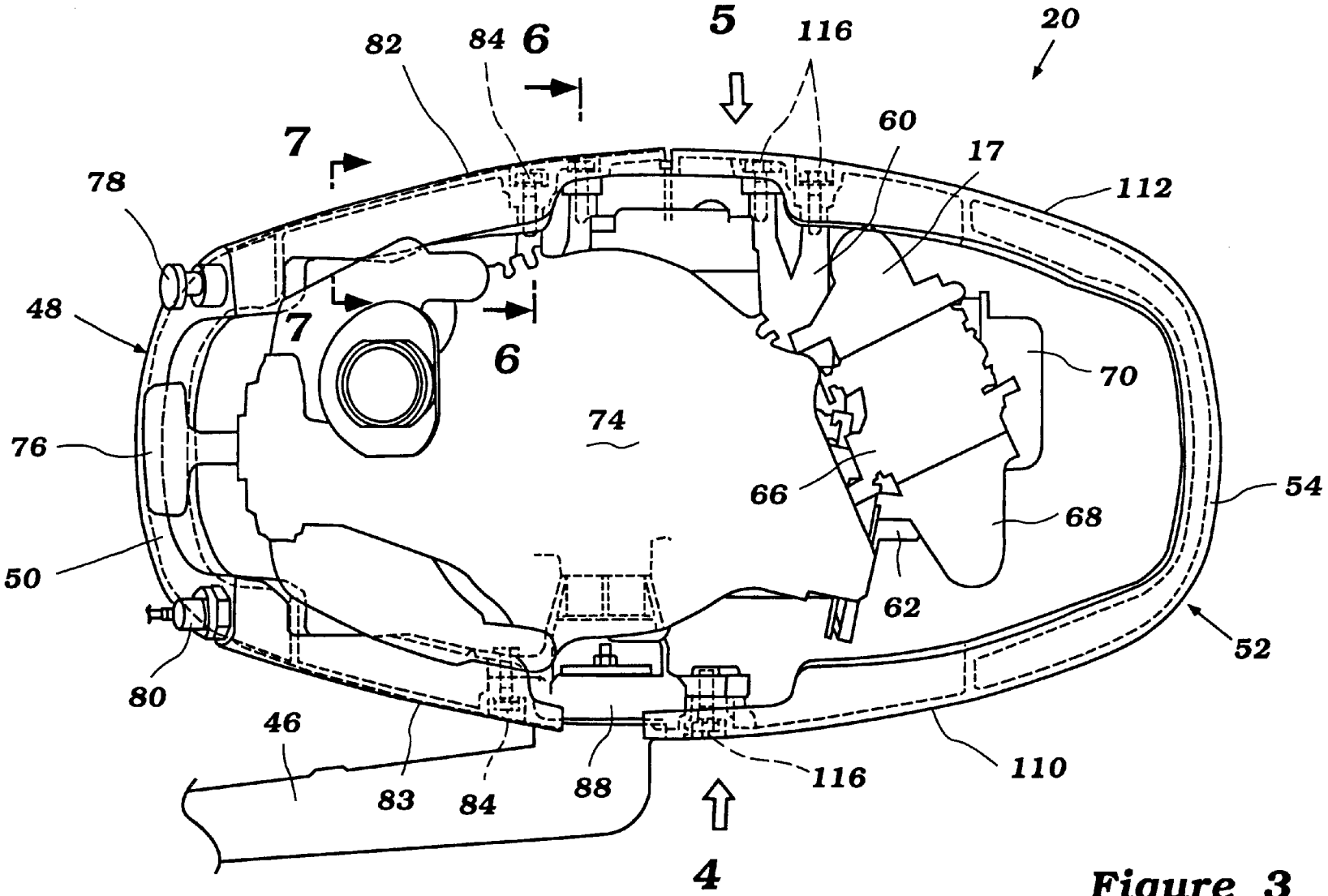
FIG. 3 is a top view of the outboard motor illustrated in FIG. 1, with a portion of a cowling thereof cut away to expose an engine therein.
Figure 5:
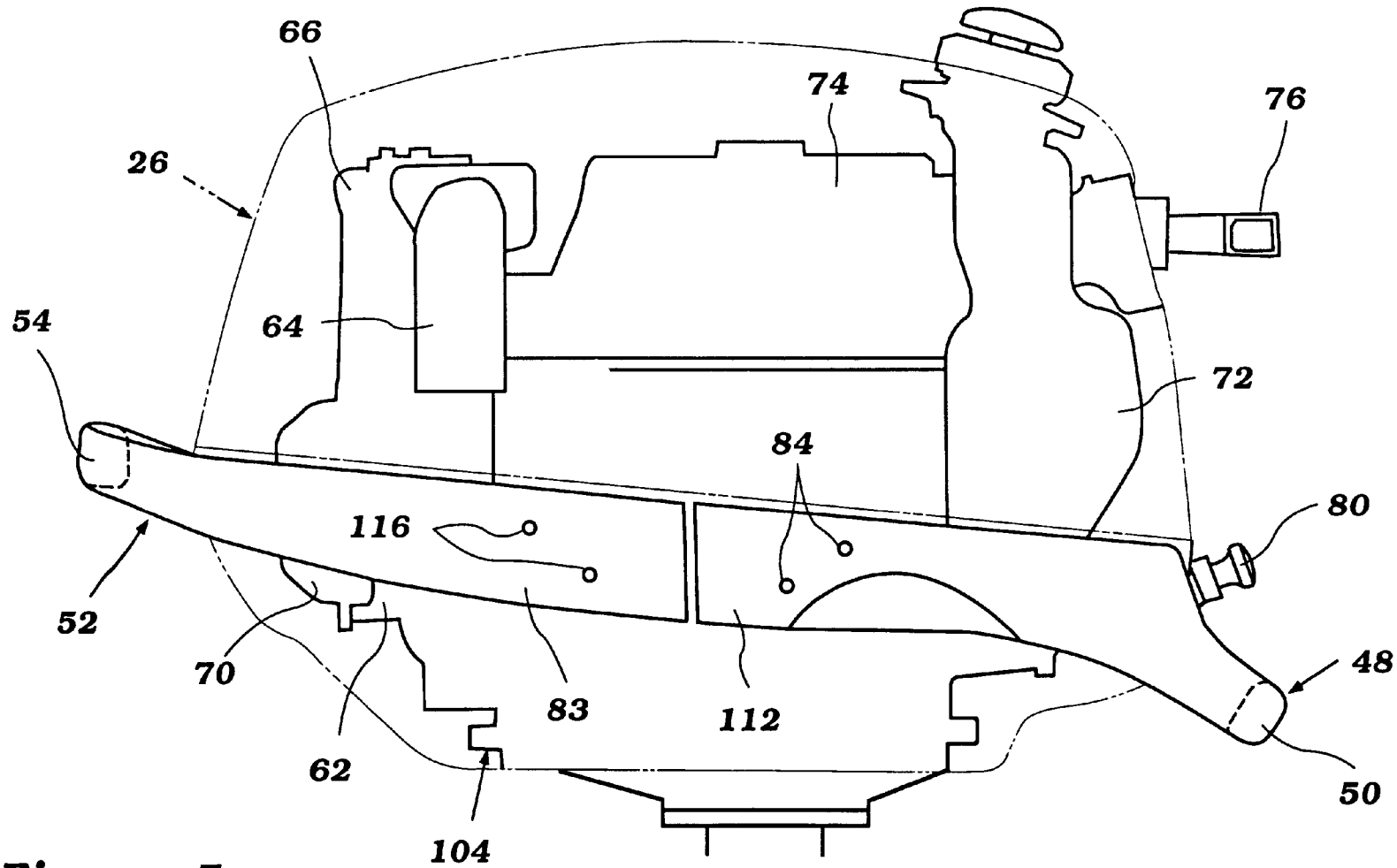
FIG. 5 is a side view of the engine to that illustrated in FIG. 3 taken in the direction of arrow 4 therein, with the cowling of the outboard motor illustrated partially in phantom.

Referring to FIGS. 3 and 5, an internal combustion engine 58 is preferably utilized to power the propeller 56. This engine 58 may operate on a two or four-cycle principale, be of a rotary type and be arranged in any variety of configurations, as well known in the art. When of the reciprocating piston-type, the engine 58 may have as few as one cylinder or have a plurality of cylinders.

As illustrated, the engine 58 includes a body 60 having a cylinder head 62 connected thereto and cooperating therewith to define at least one combustion chamber.

Air is supplied to the combustion chamber through an intake system. As illustrated, the intake system comprises a silencer 64 through which air within the cowling 24 is drawn. This air flows through a carburetor 66, through a passage defined by an intake manifold 68, and thereon to the combustion chamber.

One or more valves (not shown) may be provided for timing the flow of air into the combustion chamber. These valves may be controlled by a valve operating mechanism positioned on the cylinder head 62 and enclosed by a cylinder head cover 70 connected thereto.

Fuel is supplied to the combustion chamber for combustion with the air. Fuel is drawn from a fuel tank 72 by a fuel pump. This fuel is delivered to the carburetor 66, which in turn delivers the fuel to the air passing therethrough.

Those of skill in the art will appreciate that the intake system and fuel system may vary from that described above. For example, the fuel system may include one or more fuel injectors which are arranged to deliver the fuel, either indirectly into the air or directly into the combustion chamber.

A piston or other member is movably mounted in the engine 58 in response to the combustion of the fuel in the combustion chamber. This member is arranged to drive an output shaft (not shown) which is in a driving arrangement with the propeller 56.

Of course, the engine 58 preferably includes a throttle or similar mechanism for controlling its speed. The throttle may be incorporated into the steering handle 46.

A starter mechanism is provided for starting the engine 58. In the embodiment illustrated, a manual starter mechanism 74 is provided at a top end of the engine 58 (such as connected to a top end of the output shaft which extends outwardly from the body 60 of the engine 58 at its top end). The manual starter 74 includes a starter handle 76 which is positioned exterior to the cowling 24. The handle 76 may be connected to a pulley (not shown) associated with the starter 76 by a cord, as well known to those of skill in the art.

A choke lever 78 is also mounted exterior to the cowling 24. The choke lever 78 is connected to a choke valve (not shown) or similar mechanism associated with the engine 58.

A kill switch 80 is mounted exterior to the cowling 24. In one position the kill switch 80 is arranged to shut off the engine 58, as by grounding the ignition.

As illustrated, the starter handle 76, choke lever 78 and kill switch 80 are all mounted at a front end of the outboard motor 20. The front end of the motor 20 is that end which is closest the watercraft 22 when the motor is connected thereto.

While the construction of the engine 58 has not been described in detail, such is well known to those of skill in the art and does not form a portion of the invention herein per se.

Figure 8:
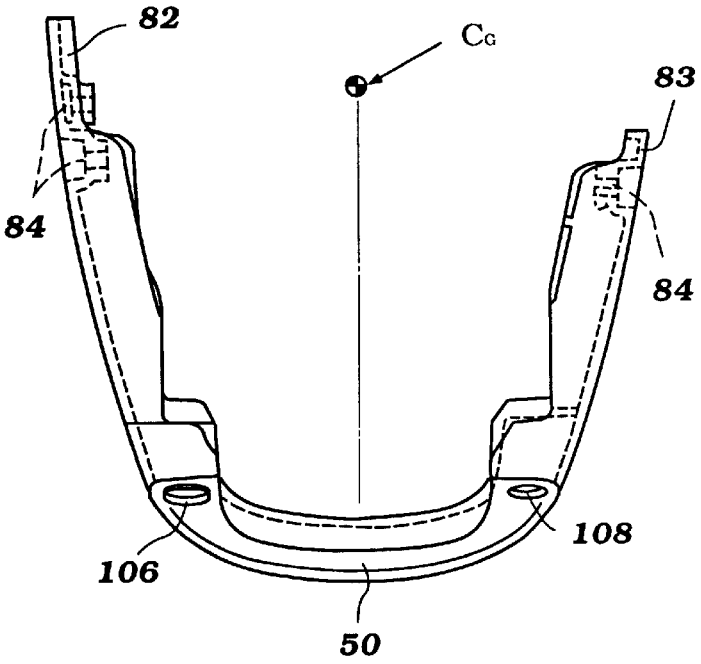
FIG. 8(*a*) is an end view of a carrying handle of the outboard motor of the present invention.
Figure 8:
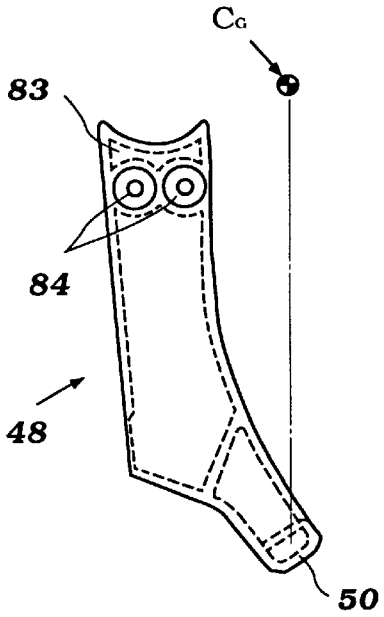
Figure 8:
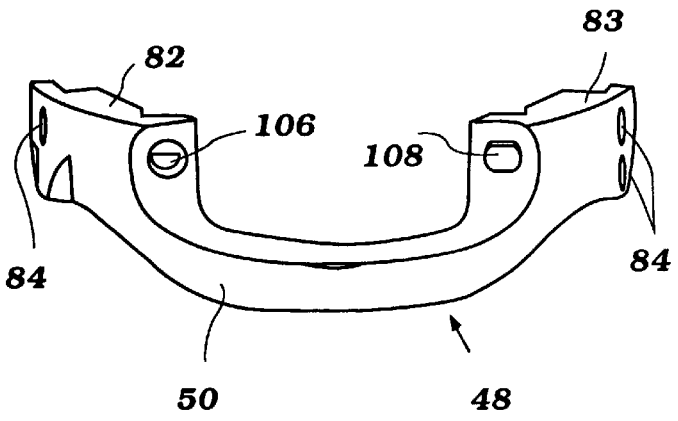
Figure 8:
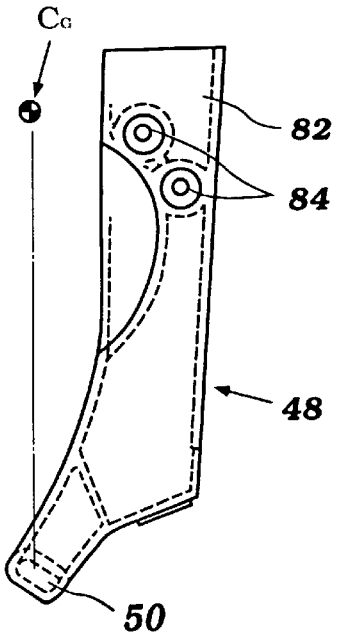

The front and rear handles 48,54 will now be described in more detail. Referring primarily to FIGS. 8(*a*)–(*d*), the front handle 48 is generally "U"-shaped. The grip 50 of the front handle 48 is positioned between a first side 82 and a second side 83. The sides 82,83 extend generally parallel to one another and generally perpendicular to the grip 50.

The front handle 48 is connected to the main cowling 24 on either side thereof. As illustrated, each side 82,83 of the front handle 48 has a pair of passages 84 therethrough near an end opposite the grip 50. When the front handle 48 is connected to the motor 20, a bolt 86 or other fastener passes through each passage 84 through the first side 82 into engagement with the cowling 24, as illustrated in FIGS. 3–6. The bolts 86 extending through the passage 84 through the second side 83 preferably engage a mounting member 88.

Figure 10:
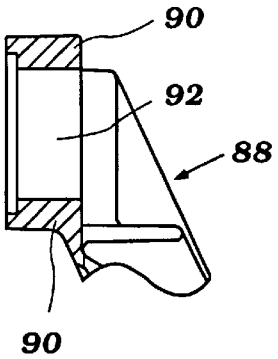
FIG. 10(*a*) is a top view of the mounting member of the outboard motor of the present invention.
Figure 10:
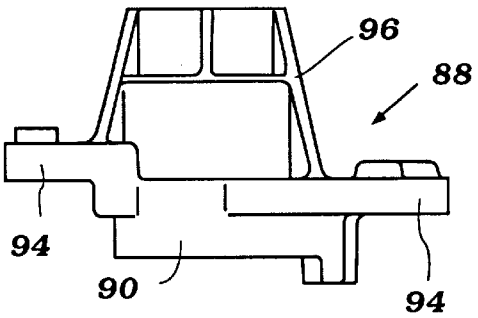
Figure 10:
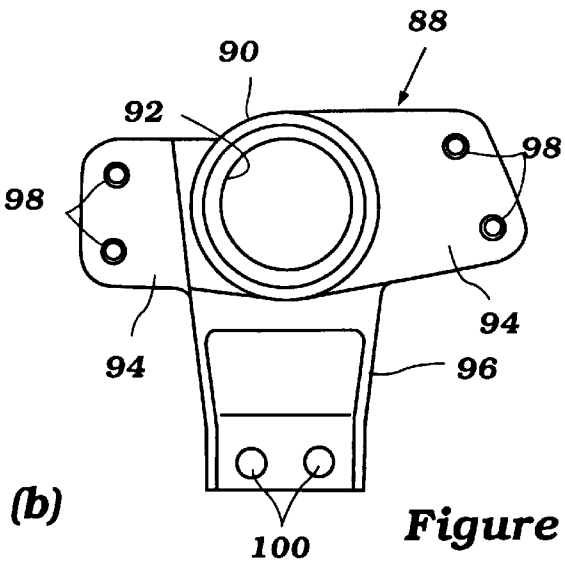
Figure 10:
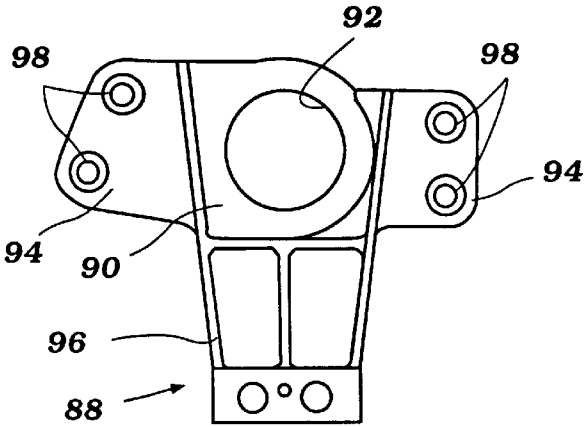
Figure 10:
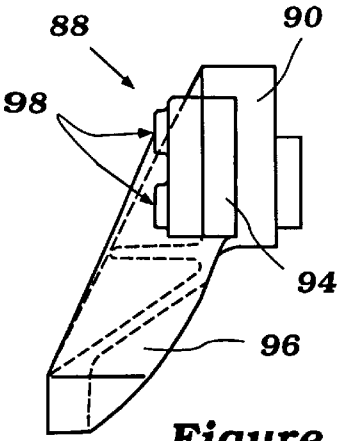

The mounting member 88 is illustrated in FIGS. 10(*a*)–(*e*). Referring to FIG. 10(*e*), the mounting member 88 has a central section 90 which defines a large passage 92. A pair of wings 94 extend outwardly from either side of the central section 90. These wings 94 extend perpendicular to a line passing through the passage 92.

A mounting part 96 extends from the central section 90 as well. The mounting part 96 extends downwardly and outwardly from the central section 90 as compared to the wings 94.

The wings 94 each have a pair of passages 98 therethrough. The mounting part 96 also has a pair of passages 100 therethrough.

Figure 4:
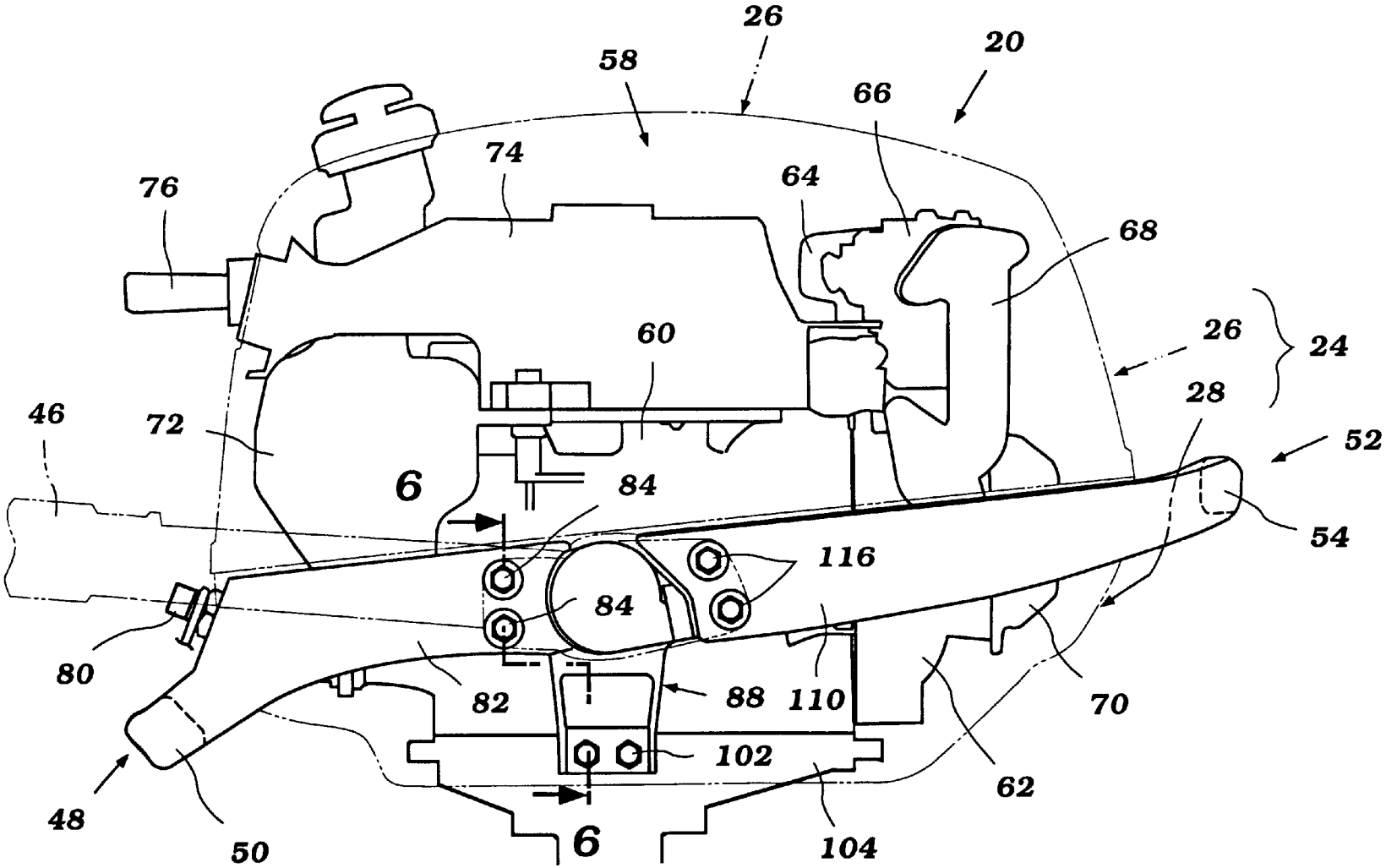
FIG. 4 is a side view of the engine illustrated in FIG. 3 taken in the direction of arrow 4 therein, with the cowling of the motor illustrated in phantom.
Figure 6:
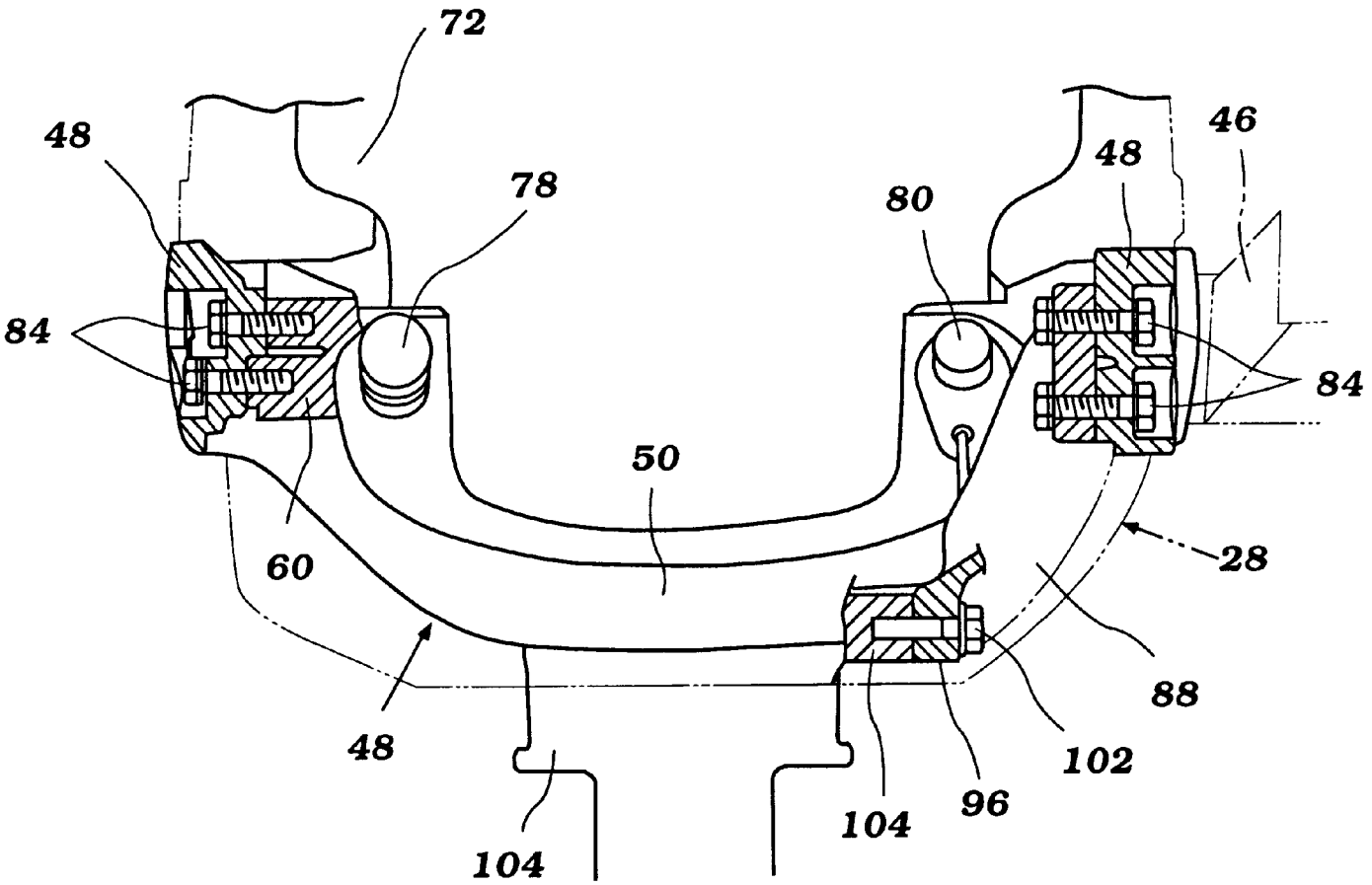
FIG. 6 is a partial cross-sectional view of the outboard motor of the present invention, a first side of the motor having the cross-section taken along line 6—6 in FIG. 3, and a second side of the motor illustrated having the cross-section taken along line 6—6 in FIG. 4.

Referring to FIGS. 4 and 6, the mounting member 88 is connected to an engine mount member 104 which is positioned below the engine 58. A bolt 102 or other fastener passes through each passage 100 in the mounting part 96 into engagement with the engine mount member 104. The steering handle 46 has a portion which extends through the large passage 92 through the central section 90 of the mounting member 88 and is secured thereto.

The second side 83 of the front handle 48 is secured to the motor 20 via the mounting member 88, as illustrated in FIG. 6. The bolts 84 extend through not only the passages 84 in the side 83, but the aligned passages 98 in one of the wings 94 of the mounting member 88.

Referring again to FIGS. 8(*a*)–(*d*) and to FIG. 6, a pair of bores 106,108 are provided in the front handle 48 near the intersection of the grip 50 and the sides 82,83. The choke lever 78 extends through one of the bores 106, while the kill switch 80 is mounted at the other bore 108.

Figure 9:
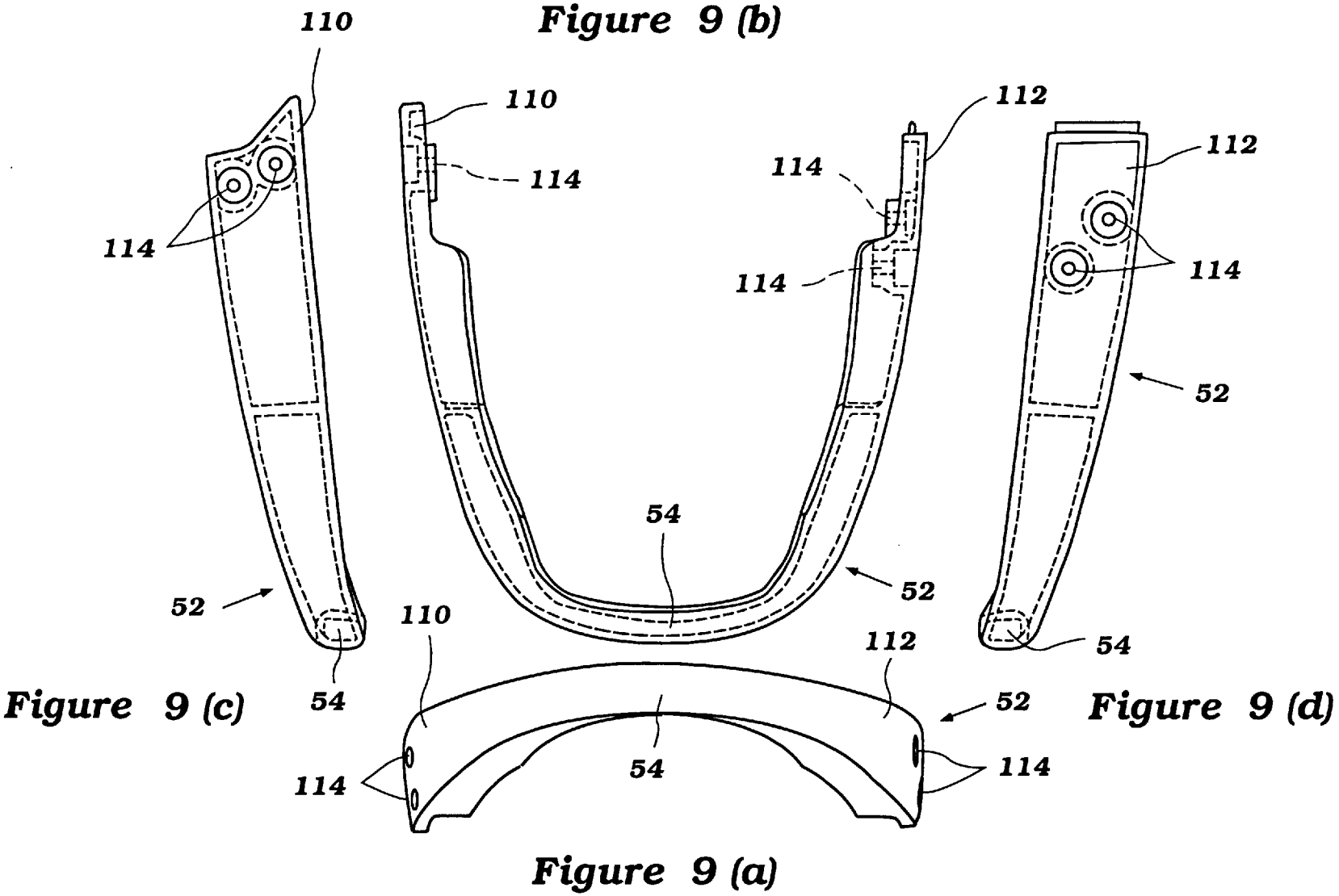
FIG. 9(*a*) is an end view of a rear handle of the outboard motor of the present invention.

The rear handle 52 will be described with reference primarily to FIGS. 9(*a*)–(*d*). The rear handle 52 is similar in shape to the front handle 28, being generally "U"-shaped. The rear grip 54 is positioned between a first side 110 and a second side 112 of the rear handle 52. The first and second sides 110,112 extend generally parallel to one another and generally perpendicular to the grip 54.

A pair of passages 114 extend through each of the sides 110,112 of the rear handle 52 near the ends of the sides opposite the grip 54. The second side 112 of the rear handle 52 is connected to the motor 20 via bolts 116 which pass through the passages 114 through that side 112. The first side 110 of the rear handle 52 is connected to the motor 20 via the mounting member 88. A bolt 116 passes through each passage 114 in the first side 110, an aligned passage 98 of one of the wings 94 of the mounting member 88, and into the cowling 24.

Figure 7:
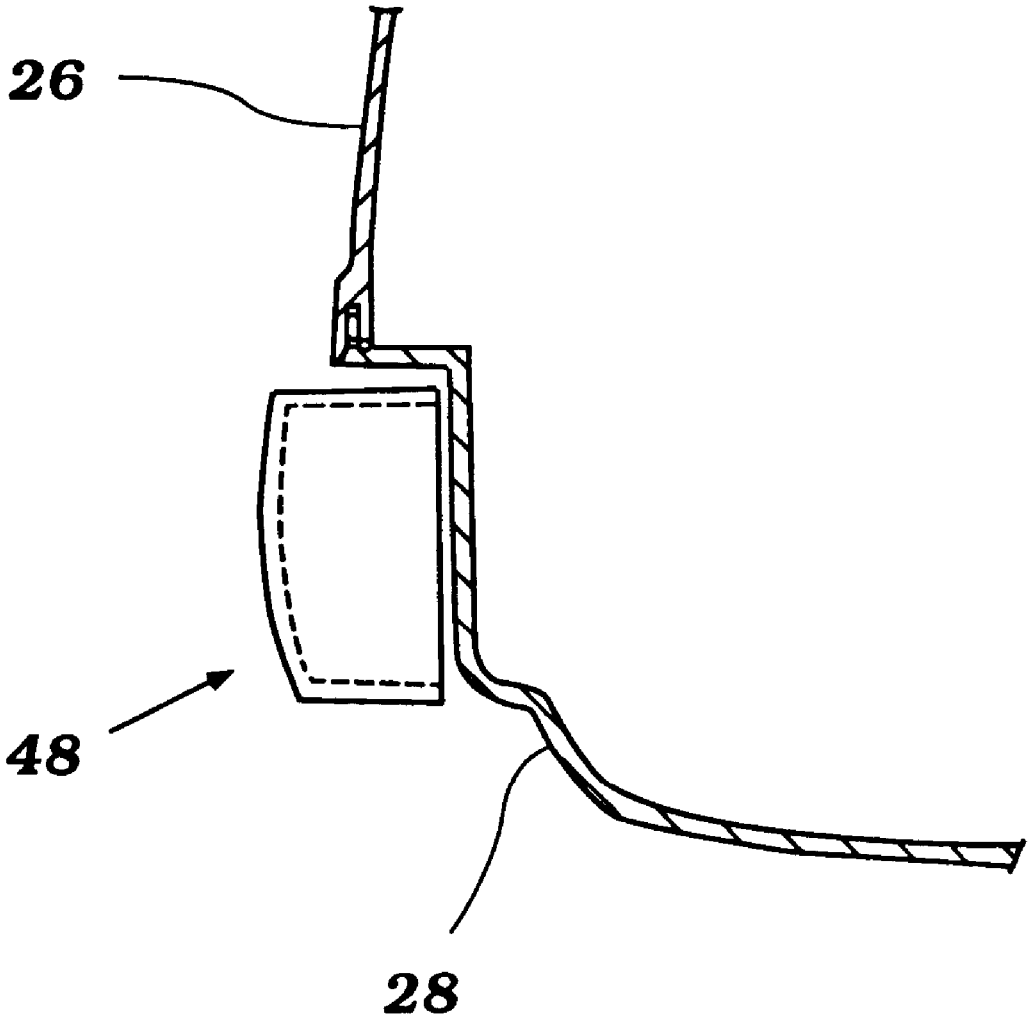
FIG. 7 is a partial cross-sectional view of the outboard motor taken along line 7—7 in FIG. 3.

The arrangement of the motor 20 as described above has several advantages over the prior art. The front and rear handles 48,52 each extend around the outside of approximately one-half of the cowling 24. Together, the handles 48,52 encircle the main cowling 24 of the motor 20. As illustrated in FIG. 7, except where the handles 48,52 are connected to the remainder of the motor 20, they are spaced slightly therefrom. In this arrangement, the handles 48,52 protect the cowling 24 and the components therein in the event the motor 20 is bumped or dropped. The handles 48,52, in effect, serve as bumpers for the motor 20.

The front handle 48 is arranged so that the motor 20 is easy to carry. Referring to FIGS. 1, 2 and 8(*a*)–(*d*), the motor 20 has a center of gravity $C_G$. The front handle 48 is arranged so that when a user 120 is transporting the motor 20 by carrying it when gripping the front grip 50, the motor 20 is balanced. As illustrated, when the motor 20 is in a generally horizontal position (i.e. the front end of the motor 20 is facing up), the grip 50 is positioned vertically above the center of gravity $C_G$. Alternatively, as illustrated in FIG. 1, when the motor 20 is upright and the grip 50 is in a horizontal position, it lies in substantially the same plane as the center of gravity $C_G$. Referring again to FIG. 2, when a user 120 is carrying the motor 20 (the motor 20 being arranged horizontally and not upright) while gripping the grip 50, the motor 20 remains level, and neither the propeller 56 nor the cowling 24 hits the ground.

The rear handle 52 may also be used to carry the motor 20, but is more suitable for use in positioning the motor 20 on the watercraft 22.

Because the front and rear handles 48,52 serve somewhat different functions, the above-described arrangement where the handles 48,52 are separate elements is advantageous since either handle may be replaced without the other.

The mounting arrangement of the choke lever 78 and kill switch 80 to the front handle 48 is also advantageous. In this arrangement, both the lever 78 and switch 80 are positioned close to the operator of the watercraft 22 at the front end of the motor 20 and are not hidden or otherwise inaccessible.

Those of skill in the art will appreciate that the front and rear handles 48,52 may be connected to the motor 20 in a variety of ways other than that described above. For example, the handles 48,52 need not be connected to the motor 20 with a pair of bolts on each side, but only a single bolt or more than one. In addition, the handles 48,52 may be fastened with other than bolts, such as screws, welding, or the like.

The handles 48,52 also do not need to be connected to one side of the motor 20 with the mounting member 88. This arrangement provides a simple and convenient mounting arrangement, however, for both handles 48,52 and the steering handle 46.

Those of skill in the art will also appreciate that the exact shape of the front and rear handles 48,52 may vary. For example, each grip 50,54 may be contoured or sculpted for easy gripping by a user. In addition, the grips 50, 54 may comprise separate elements which are attached to the front and rear handles 48, 52.

The front and rear handles 48,52 may be made from a wide variety of materials which are durable and weather resistant, including metal, plastic and other materials.

As configured, the grips 50,54 of the handles 48,52 are positioned at the front and rear ends, respectively end of the outboard motor 20 where they are easily accessed. The handles 48,52 are positioned slightly below the interface between the upper and lower portions 26,28 of the main cowling 24, permitting the user to remove the upper portion 26 of the cowling to access the engine 58 therein.

Of course, the foregoing description is that of preferred embodiments of the invention, and various changes and modifications may be made without departing from the spirit and scope of the invention, as defined by the appended claims.

What is claimed is:

1. An outboard motor comprising a water propulsion device and a cowling housing an internal combustion engine, said engine having a body defining at least one combustion chamber and having an output shaft arranged to drive said water propulsion device, said cowling having a front end and a rear end, said motor having a handle which generally encircles at least a portion of said cowling, said handle being attached to said cowling at a plurality of attachment locations and spaced from said cowling between said attachment locations, said handle having at least one gripping portion at said front or rear end of said cowling.

2. The outboard motor in accordance with claim 1, wherein said handle comprises a front handle and a rear handle.

3. The outboard motor in accordance with claim 2, wherein said front handle and rear handle each have a grip portion extending between a pair of sides, said sides connected to said cowling.

4. The outboard motor in accordance with claim 3, wherein at least one of said sides of each of said front and rear handles is connected to a mounting member which is disposed at the attachment location and is connected to said motor.

5. The outboard motor in accordance with claim 2, wherein said front handle includes a grip located at said front end of said cowling and said rear handle includes a grip located at said rear end of said cowling.

6. The outboard motor in accordance with claim 1, wherein said outboard motor has a center of gravity and said grip of said handle is substantially aligned with said center of gravity in a vertical direction when said output shaft is substantially horizontal.

7. The outboard motor in accordance with claim 1, wherein said outboard motor has a center of gravity and said grip of said handle is in generally the same horizontal plane as said center of gravity when said motor is upright.

8. The outboard motor in accordance with claim 1, wherein said handle supports a choke lever.

9. The outboard motor in accordance with claim 1, wherein said handle supports a kill switch.

10. The outboard motor of claim 2, wherein the handles are individually removable from the attachment locations on the motor.

11. An outboard motor having front and rear ends and comprising a power head and a water propulsion device, said power head comprising a cowling, a mounting member, and a handle connected to the mounting member and generally encircling at least a portion of the cowling, the cowling housing an internal combustion engine having an output shaft arranged to drive the water propulsion device, the handle comprising a grip portion configured so that the grip is substantially aligned in a vertical direction with a center of gravity of the motor when the output shaft is substantially horizontal.

12. The outboard motor of claim 11, wherein the handle comprises a front handle portion having a front grip portion, and the front handle is configured so that the front grip is substantially aligned in a vertical direction with the center of gravity when the front end of the motor is facing upward.

13. The outboard motor of claim 11, wherein a first mounting member is positioned on a first side of the motor and a second mounting member is positioned on a second side of the motor, and the handle is spaced from the cowling between the mounting members.

14. The outboard motor of claim 13, wherein the handle portion comprises a front handle having a front grip and a rear handle having a rear grip.

15. The outboard motor of claim 14, wherein the front and rear handles are independently attached to the mounting members.

16. The outboard motor of claim 15, wherein at least one of the mounting members comprises a front attachment portion and a rear attachment portion, and the front handle is attached to the front attachment portion and the rear handle is attached to the rear attachment portion.

17. The outboard motor of claim 11, wherein the engine is supported on an engine mount and the mounting member is connected to the engine mount.

18. The outboard motor of claim 17, wherein the mounting member comprises a handle attachment portion at which the handle is connected to the mounting member, and the handle attachment portion is oriented above the center of gravity of the motor when the motor is upright.

19. The outboard motor of claim 11, wherein the cowling is attached to the mounting member.

20. An outboard motor comprising a water propulsion device and a cowling housing an internal combustion engine, said engine having a body defining at least one combustion chamber and having an output shaft arranged to drive said water propulsion device, said cowling having a front end and a rear end, said motor having a handle which generally encircles at least a portion of said cowling and comprises a front handle and a rear handle, said front and rear handles each having a gripping portion.

21. An outboard motor as in claim 20, additionally comprising a plurality of mounting members, and the handle is attached to the mounting members.

22. An outboard motor as in claim 21, wherein the mounting members comprise front mounting portions and rear mounting portions, and the front handle is attached to the front mounting portion and the rear handle is attached to the rear mounting portion.

23. An outboard motor as in claim 22, wherein the front and rear handles are independently removable from the mounting members.

* * * * *